US012146308B2

(12) United States Patent
Kim

(10) Patent No.: US 12,146,308 B2
(45) Date of Patent: Nov. 19, 2024

(54) WATER SUPPLY SYSTEM FOR SANITARY CERAMICS

(71) Applicant: ACE LIFE CO., LTD., Asan-si (KR)

(72) Inventor: Chang Ho Kim, Pyeongtaek-si (KR)

(73) Assignee: ACE LIFE CO., LTD., Asan-si (KR)

( * ) Notice: Subject to any disclaimer, the term of this patent is extended or adjusted under 35 U.S.C. 154(b) by 128 days.

(21) Appl. No.: 18/166,779

(22) Filed: Feb. 9, 2023

(65) Prior Publication Data

US 2023/0399832 A1 Dec. 14, 2023

(30) Foreign Application Priority Data

Jun. 14, 2022 (KR) ..... 10-2022-0072080

(51) Int. Cl.
*E03D 1/34* (2006.01)
*E03D 5/10* (2006.01)

(52) U.S. Cl.
CPC *E03D 1/34* (2013.01); *E03D 5/10* (2013.01)

(58) Field of Classification Search
CPC ..... E03D 1/34
See application file for complete search history.

(56) References Cited

FOREIGN PATENT DOCUMENTS

| | | | |
|---|---|---|---|
| JP | 2010007341 A | * | 1/2010 |
| KR | 200453734 Y1 | | 5/2011 |
| KR | 102331094 B1 | | 12/2021 |

* cited by examiner

*Primary Examiner* — Christine J Skubinna
(74) *Attorney, Agent, or Firm* — Rabin & Berdo, P.C.

(57) ABSTRACT

Provided is a water supply system for sanitary ceramics in which, when a diaphragm configured to move downward is seated on a rotary cam device, the rotary cam device is eccentrically rotated and guides the diaphragm to gradually move downward, and here, an upper end of a water discharge hole is gradually blocked by the diaphragm, and a flow of water discharged through the water discharge hole is prevented from being suddenly blocked. According to the present disclosure, there are advantages that a rotary cam device supports a diaphragm configured to move downward and, by being eccentrically rotated, guides the diaphragm to gradually move downward so that a water discharge hole is prevented from being suddenly blocked by the diaphragm and the water discharge hole is gradually blocked to prevent a flow of water discharged through the water discharge hole from being suddenly blocked.

10 Claims, 9 Drawing Sheets

WATER SUPPLY SYSTEM FOR SANITARY CERAMICS

CROSS-REFERENCE TO RELATED APPLICATION

This application claims priority to and the benefit of Korean Patent Application No. 10-2022-0072080, filed on Jun. 14, 2022, the disclosure of which is incorporated herein by reference in its entirety.

BACKGROUND

1. Field of the Invention

The present disclosure relates to a water supply system, and more particularly, to a water supply system for sanitary ceramics in which a diaphragm configured to move downward is supported by a rotary cam device installed on an inner wall surface of a water discharge hole of a housing, and in that state, the rotary cam device is eccentrically rotated and the diaphragm is gradually moved downward to block the water discharge hole so that a flow of water discharged through the water discharge hole is prevented from being suddenly blocked.

2. Discussion of Related Art

Generally, a toilet always maintains a state in which residual water stagnates in a bowl configured to accommodate waste, and water is supplied to the toilet when discharging the waste and cleaning the bowl.

Here, a water supply system provided in a toilet is divided into a rim water supply configured to cause a rotating water flow on the entire surface of the bowl to clean waste or foreign matter attached to the inside of the bowl and a jet water supply configured to cause water to flow toward a drain hole to discharge the waste inside the bowl to a wastewater tank.

Patent Document 1 discloses a manual water supply system of a conventional sanitary ceramic with an integrated bidet. Referring to Patent Document 1, the manual water supply system includes a water supply configured to supply washing water, which is supplied from a tap, to the sanitary ceramic, a fill valve seated on first and second pipes of the water supply to selectively open and close the first and second pipes, and a second operator configured to, due to pressing of a lever, open a drain hole of the water supply so that the fill valve is operated and supply the washing water to a rim side and a jet water channel of a bowl.

Here, the second operator includes the lever configured to be pressed to supply the washing water supplied to the water supply to each of the rim side and the jet water channel of the bowl, a rotating member configured to rotate about a rotation axis by the lever and move a core of a lifting/lowering driving device upward to open the drain hole of the water supply, and a restoring spring configured to restore the lever.

Here, water is discharged through the rim side and the jet water channel by simultaneously discharging water through the first pipe and the second pipe or selectively discharging water through the first pipe or the second pipe.

That is, when the lifting/lowering driving device is operated to cause the core to move upward while water is supplied through the water supply, the drain hole which has been blocked and is disposed at a lower end of the lifting/lowering driving device is opened, and simultaneously, pressure at an upper side of the fill valve is decreased, and thus the fill valve moves upward due to being pushed by the pressure of the water supplied through the water supply.

Then, an upper end of the first pipe is opened by the fill valve and maintains communication with the water supply. Here, water is discharged through the upper end of the first pipe, and thus water is supplied to the rim side.

On the other hand, in the above method, when the lifting/lowering driving device is operated to cause the core to move upward, an upper end of the second pipe is opened, and thus water is supplied to the jet water channel.

However, Patent Document 1 described above has problems that, as the core is excessively moved upward or downward by the lifting/lowering driving device and the drain hole is opened or closed instantaneously, the upward or downward movement of the fill valve suddenly occurs, and due to the sudden upward or downward movement of the fill valve, impact is transmitted to the fill valve or the first and second pipes and product damage occurs. Also, as water moving toward the first pipe or second pipe through a water supply pipe collides with the fill valve suddenly blocking the first pipe or second pipe, a water hammer occurs, and due to the water hammer, noise is generated inside the product and causes a user of the water supply system to feel anxious. Due to frequent water hammers, a vibration or shock wave is transmitted to pipes or surrounding components, causing cracks or damage to occur in old pipes or surrounding components, and due to the product damage, it is difficult to perform maintenance and repair, and the product reliability is reduced.

RELATED ART DOCUMENT

Patent Document (Patent Document 1) KR20-0453734 Y1

SUMMARY OF THE INVENTION

The present disclosure is directed to providing a water supply system for sanitary ceramics, the water supply system having a housing in which a water supply hole and water discharge holes, disposed at both sides of the water supply hole and connected to a flow path, are formed, wherein a diaphragm is formed on an upper side of the water discharge hole of the housing, a support protrusion is formed on an upper portion of the diaphragm, a dividing cap having a through-hole formed therein to communicate with upper and lower spaces of the housing is formed, an opening/closing member configured to move upward or downward to open or close the through-hole is formed on an upper surface of the dividing cap, and a rotary cam device configured to support a lower end of the diaphragm and eccentrically rotate is installed on an inner wall surface of the water discharge hole so that, when the diaphragm moving downward is seated on the rotary cam device, the rotary cam device is eccentrically rotated and guides the diaphragm to gradually move downward, and here, an upper end of the water discharge hole is gradually blocked by the diaphragm, and thus a flow of water discharged through the water discharge hole is prevented from being suddenly blocked.

A water supply system for sanitary ceramics according to the present disclosure includes: a housing which is hollow and in which a water supply hole is formed at a central portion of a lower end, a pair of water discharge holes are formed at lower ends of both sides based on the water supply hole, and a flow path configured to guide water introduced through the water supply hole to be discharged through the water discharge hole is formed between the water supply hole and the water discharge hole; and an opening/closing device installed on an upper side of the water discharge hole of the housing to open or block an upper end of the water discharge hole, wherein the opening/closing device includes a diaphragm which is installed on an upper portion of the water discharge hole, has a guide hole formed in an outer edge thereof, and is configured to move upward or downward to open or close the water discharge hole, a dividing cap which is installed on an upper portion of the diaphragm to divide an inside of the housing into upper and lower spaces and has a support protrusion formed on an upper surface thereof and a through-hole formed downward from an upper surface of the support protrusion to communicate with the upper and lower spaces, an opening/closing member which is installed to be movable upward or downward in the upper space of the housing to come in close contact with the upper surface of the support protrusion of the dividing cap or move away from the upper surface of the support protrusion to open or block the through-hole, a lifting/lowering driving device which is installed to be fixed to an upper surface of the housing that faces the water discharge hole and has a lower end connected to the opening/closing member to move the opening/closing member upward or downward, and a rotary cam device which is rotatably installed on an inner wall surface of the water discharge hole of the housing and configured to allow the diaphragm, which is moving downward, to be supported by an outer surface thereof and, by being eccentrically rotated, guide the diaphragm to gradually move downward to guide the diaphragm to gradually block the water discharge hole.

In the water supply system for sanitary ceramics according to the present disclosure, the rotary cam device may be installed on an inner wall surface of any one of the water discharge holes of the housing that are symmetrical to each other or installed on each of the water discharge holes of the housing that are symmetrical to each other to guide the downward movement of the diaphragm.

In the water supply system for sanitary ceramics according to the present disclosure, the rotary cam device may include: a shaft which has one end rotatably installed on the inner wall surface of the water discharge hole of the housing and the other end installed to be exposed to an outside of the housing and has an eccentric protrusion formed on an outer surface to support the diaphragm and, by being eccentrically rotated, guide the diaphragm to gradually move downward; and a stepper motor which is installed to be fixed to an outer surface of the housing and is connected to the other end of the shaft to rotate the shaft by a predetermined angle.

A water supply system for sanitary ceramics according to the present disclosure includes: a housing which is hollow and in which a water supply hole is formed at a central portion of a lower end, a pair of water discharge holes are formed at lower ends of both sides based on the water supply hole, and a flow path configured to guide water introduced through the water supply hole to be discharged through the water discharge hole is formed between the water supply hole and the water discharge hole; and an opening/closing device installed on an upper side of the water discharge hole of the housing to open or block an upper end of the water discharge hole, wherein the opening/closing device includes a diaphragm which is installed on an upper portion of the water discharge hole, has a guide hole formed in an outer edge thereof, and is configured to move upward or downward to open or close the water discharge hole, a dividing cap which is installed on an upper portion of the diaphragm to divide an inside of the housing into upper and lower spaces and has a support protrusion formed on an upper surface thereof and a through-hole formed downward from an upper surface of the support protrusion to communicate with the upper and lower spaces, an opening/closing member which is installed to be movable upward or downward in the upper space of the housing to come in close contact with the upper surface of the support protrusion of the dividing cap or move away from the upper surface of the support protrusion to open or block the through-hole, a lifting/lowering driving device which is installed to be fixed to an upper surface of the housing that faces the water discharge hole and has a lower end connected to the opening/closing member to move the opening/closing member upward or downward, and a horizontal movement device which is installed to be horizontally movable on an inner wall surface of the water discharge hole of the housing and configured to allow the diaphragm, which is moving downward, to come in close contact with an outer surface thereof and, by being moved backward, guide the diaphragm to gradually move downward to guide the diaphragm to gradually block the water discharge hole.

In the water supply system for sanitary ceramics according to the present disclosure, the horizontal movement device may be installed on an inner wall surface of any one of the water discharge holes of the housing that are symmetrical to each other or installed on each of the water discharge holes of the housing that are symmetrical to each other to guide the downward movement of the diaphragm.

In the water supply system for sanitary ceramics according to the present disclosure, the horizontal movement device may include: a support member which has one end disposed in the water discharge hole of the housing and the other end installed to be exposed to an outside of the housing, has an inclined surface formed on an outer surface to be tapered from the other end toward the one end to support the diaphragm, and is configured to, by being moved backward toward the outside of the housing in the water discharge hole, guide the diaphragm to gradually move downward; and a driving device which is installed to be fixed to an outer surface of the housing and is connected to the other end of the support member to move the support member backward.

In the water supply system for sanitary ceramics according to the present disclosure, the horizontal movement device may have the support member and the driving device fastened using any one of a worm gear, a rack pinion gear, and a ball screw so that the support member moves backward.

In the water supply system for sanitary ceramics according to the present disclosure, the dividing cap may further include a manual operation lever formed to be inserted and coupled to an outer surface of the support protrusion and move upward and downward along the support protrusion to press the opening/closing member placed directly above the manual operation lever so that the opening/closing member blocking the through-hole is lifted upward.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
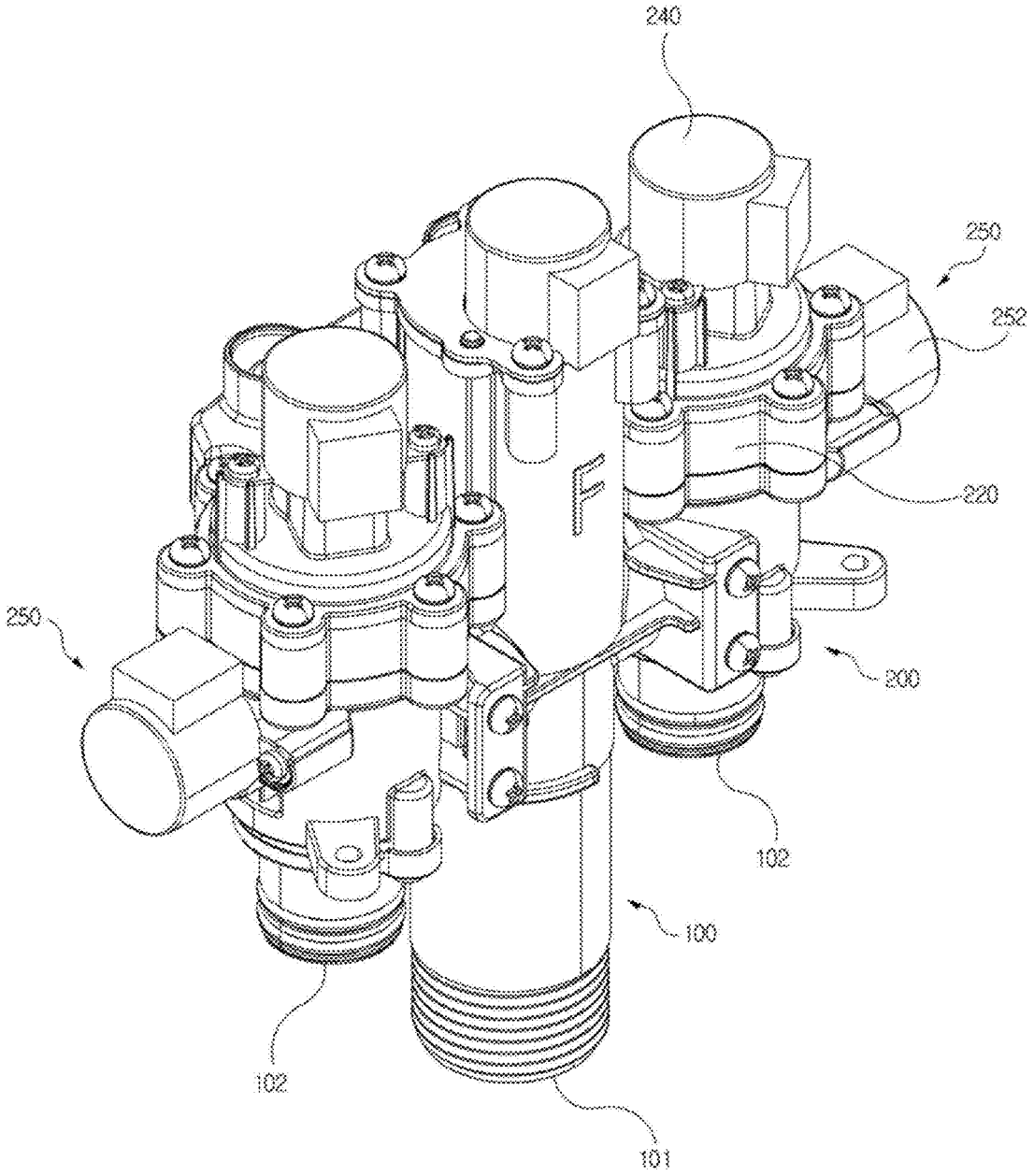
FIG. 1 is a perspective view illustrating a water supply system for sanitary ceramics according to a first embodiment of the present disclosure.
Figure 2:
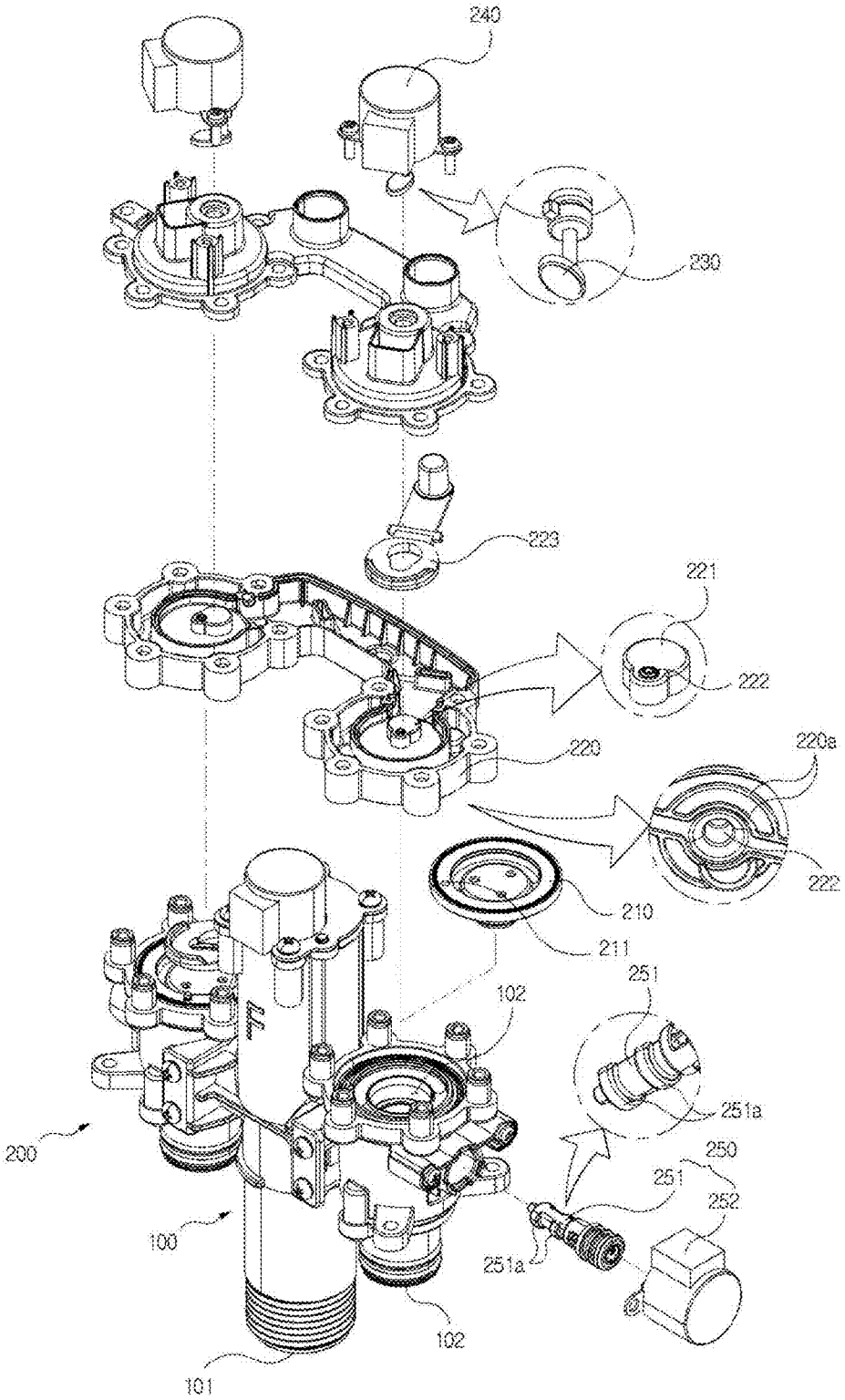
FIG. 2 is an exploded perspective view of FIG. 1.
Figure 3:
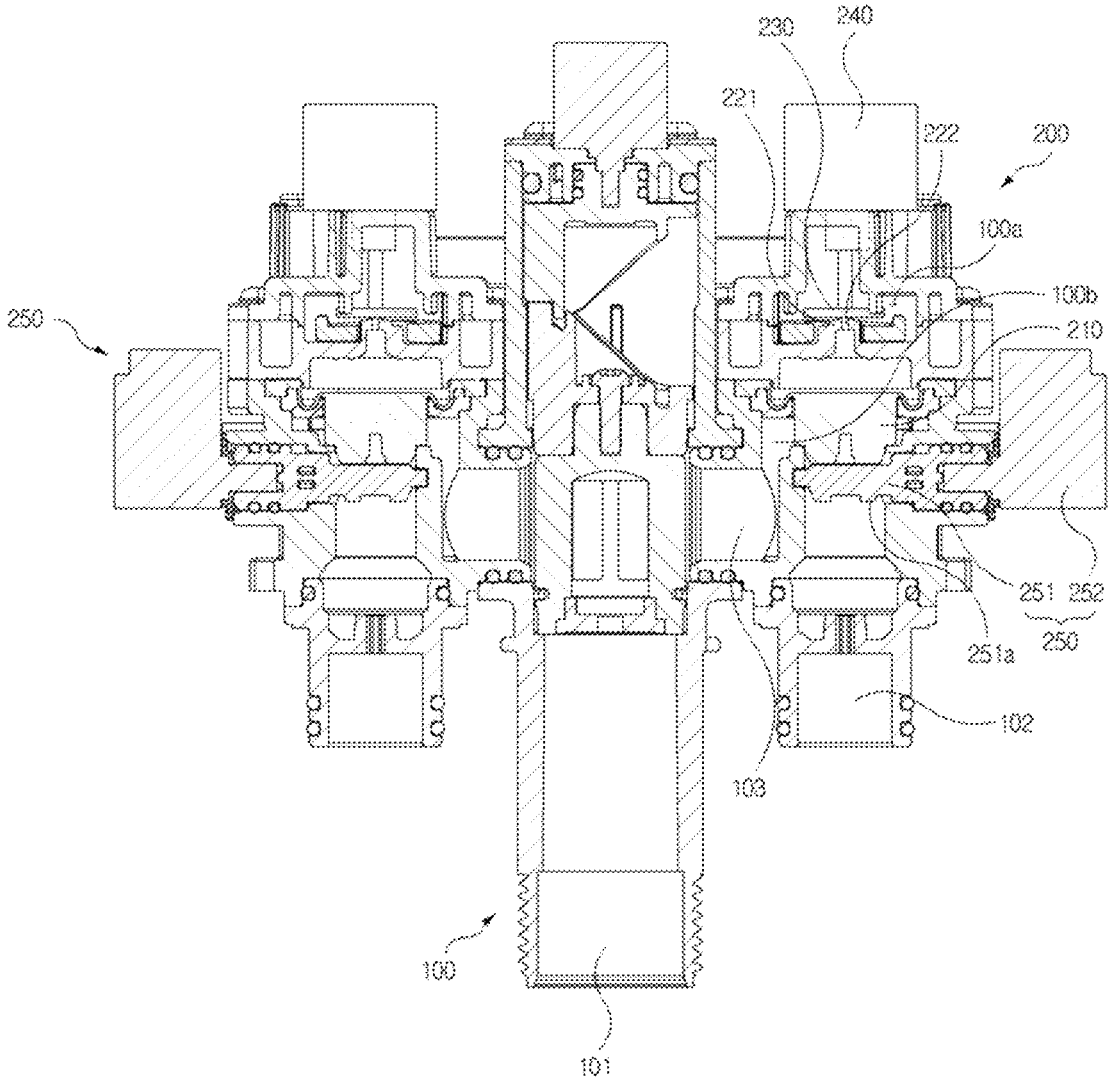
FIG. 3 is a lateral cross-sectional view of the water supply system for sanitary ceramics according to the first embodiment of the present disclosure.
Figure 4:
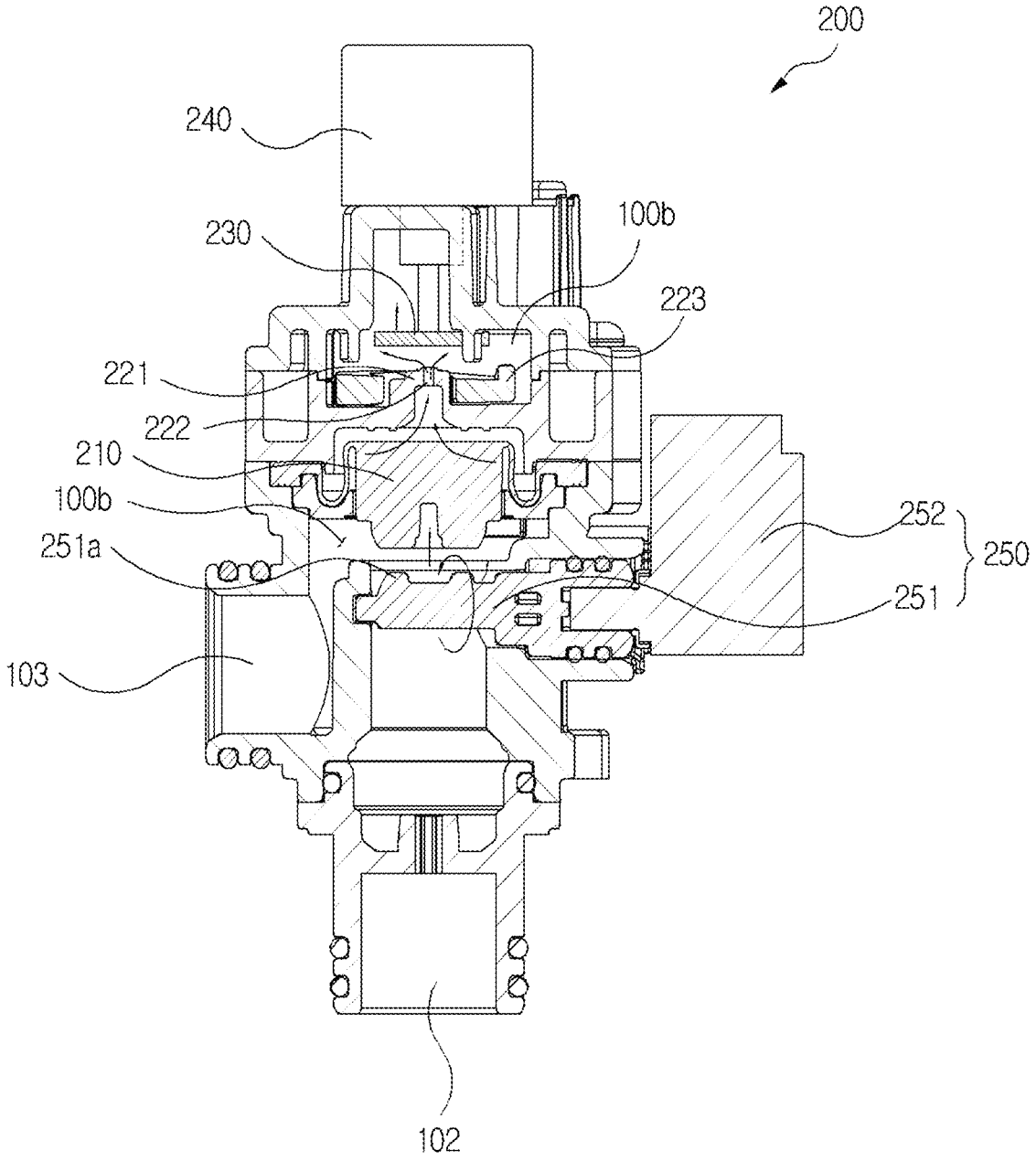
FIG. 4 is a lateral cross-sectional view illustrating a state in which a diaphragm of the water supply system for sanitary ceramics according to the first embodiment of the present disclosure is moved upward.
Figure 5:
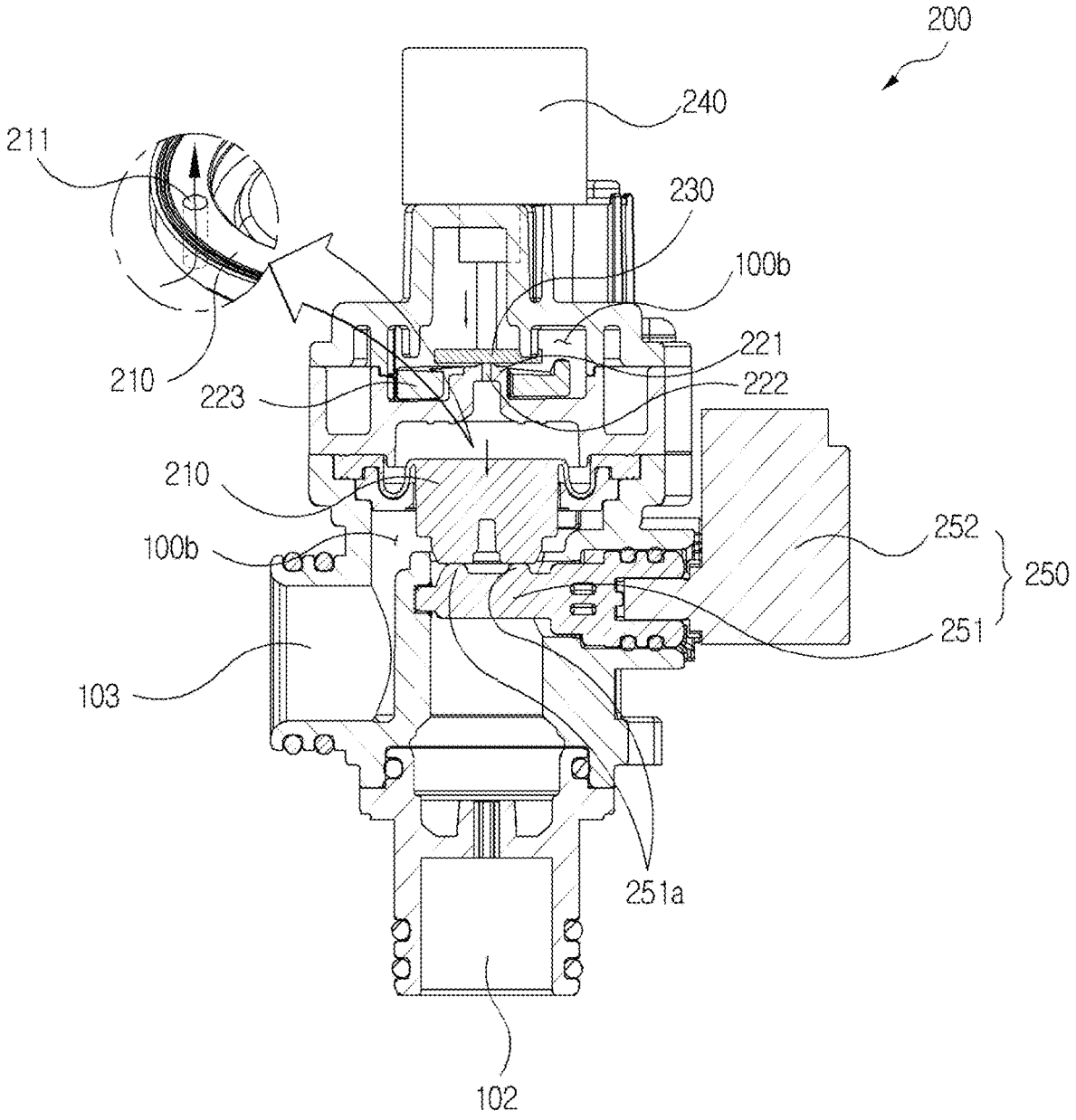
FIG. 5 is a lateral cross-sectional view illustrating a state in which the diaphragm of the water supply system for sanitary ceramics according to the first embodiment of the present disclosure is supported by a rotary cam device.
Figure 6:
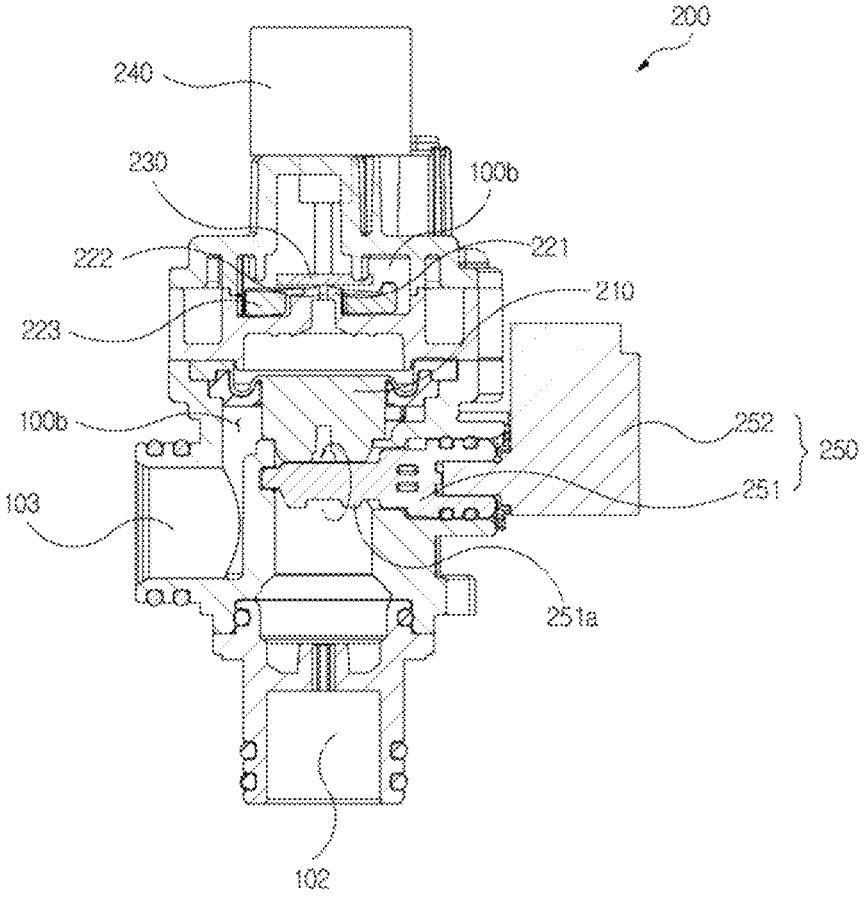
FIG. 6 is a lateral cross-sectional view illustrating a state in which the diaphragm of the water supply system for sanitary ceramics according to the first embodiment of the present disclosure is returned to its original position and blocks an upper end of a water discharge hole.

Hereinafter, embodiments of the present disclosure will be described in detail with reference to the accompanying drawings.

First Embodiment

Referring to FIGS. 1 to 6 and FIG. 9, a housing 100 is hollow and has a water supply hole 101 formed at a central portion of a lower end, a pair of water discharge holes 102 formed at lower ends of both sides based on the water supply hole 101, and a flow path 103 formed between the water supply hole 101 and the water discharge hole 102 to guide water introduced through the water supply hole 101 to be discharged through the water discharge hole 102.

The housing 100 may be installed on an inner side of a sanitary ceramic 10 or installed in a bidet device (not illustrated) rotatably installed on an upper side of the sanitary ceramic 10.

The housing 100 receives water through the water supply hole 101 and guides the water to move to the water discharge hole 102 through the flow path 103.

The flow path 103 is formed to be orthogonal to the water supply hole 101 and the water discharge hole 102.

The water discharge hole 102 is closed or opened by an opening/closing device 200.

The water discharge hole 102 of the housing 100 has an upper end disposed in a lower space 100*b* of the housing 100 and is opened or closed by a diaphragm 210 of the opening/closing device 200.

The upper end of the water discharge hole 102 is blocked by the diaphragm 210 moving downward so that discharge of water introduced through the water supply hole 101 is blocked.

A rotary cam device 250 of the opening/closing device 200 may be allowed to be rotatably installed on an inner wall surface of the water discharge hole 102.

The water discharge holes 102 are each connected to a rim pipe 12 and a jet pipe 13 installed in a bowl 11 of the sanitary ceramic 10.

The housing 100 is divided into an upper space 100*a* and the lower space 100*b* by a dividing cap 220 installed therein.

The opening/closing device 200 is installed on an upper side of the water discharge hole 102 of the housing 100 to open or block the upper end of the water discharge hole 102.

The opening/closing device 200 includes the diaphragm 210 which is installed on an upper portion of the water discharge hole 102, has a guide hole 211 formed in an outer edge thereof, and is configured to move upward or downward to open or close the water discharge hole 102, the dividing cap 220 which is installed on an upper portion of the diaphragm 210 to divide the inside of the housing 100 into the upper and lower spaces 100*a* and 100*b* and has a support protrusion 221 formed on an upper surface thereof and a through-hole 222 formed downward from an upper surface of the support protrusion 221 to communicate with the upper and lower spaces 100*a* and 100*b*, an opening/closing member 230 which is installed to be movable upward or downward in the upper space 100*a* of the housing 100 to come in close contact with the upper surface of the support protrusion 221 of the dividing cap 220 or move away from the upper surface of the support protrusion 221 to open or block the through-hole 222, a lifting/lowering driving device 240 which is installed to be fixed to an upper surface of the housing 100 that faces the water discharge hole 102 and has a lower end connected to the opening/closing member 230 to move the opening/closing member 230 upward or downward, and the rotary cam device 250 which is rotatably installed on the inner wall surface of the water discharge hole 102 of the housing 100 and configured to allow the diaphragm 210, which is moving downward, to be supported by an outer surface thereof and, by being eccentrically rotated, guide the diaphragm 210 to gradually move downward to guide the diaphragm 210 to gradually block the water discharge hole 102.

The diaphragm 210 is moved upward or downward in a state in which an edge thereof is pressed and supported between the housing 100 and an edge of the dividing cap 220.

The diaphragm 210 allows water staying in the lower space 100*b* of the housing 100 to enter a space between the diaphragm 210 and the dividing cap 220 through the guide hole 211.

The diaphragm 210 is pushed by pressure of water entering the space between the dividing cap 220 and the diaphragm 210 and thus maintains a state in which the upper end of the water discharge hole 102 is closed by the diaphragm 210.

The pressure of water staying between the diaphragm 210 and the dividing cap 220 may be equal to the pressure of water staying in the lower space 100*b* of the housing 100.

At the moment the water staying between the dividing cap 220 and the diaphragm 210 is discharged to the upper space 100*a* of the housing 100 through the through-hole 222, the diaphragm 210 is pushed by the pressure of water moving toward the water discharge hole 102 through the flow path 103 and is gradually moved upward, thus opening the upper end of the water discharge hole 102.

The dividing cap 220 divides the housing 100 into the upper space 100*a* and the lower space 100*b* and allows the opening/closing member 230 and the diaphragm 210 to be disposed in each of the upper space 100*a* and the lower space 100*b*.

The support protrusion 221 of the dividing cap 220 allows the opening/closing member 230, configured to move upward or downward in the upper space 100*a*, to come in close contact therewith and close the through-hole 222.

The through-hole 222 is opened by the opening/closing member 230 and allows the water staying in the space between the diaphragm 210 and the dividing cap 220 to be discharged to the upper space 100*a* of the housing 100 or is blocked by the opening/closing member 230 so that water stays in the space between the diaphragm 210 and the dividing cap 220.

The dividing cap 220 further includes a contact preventing protrusion 220*a* which is formed to protrude downward from an edge of a bottom surface of the through-hole 222 and prevents the diaphragm 210, moving upward and away from the water discharge hole 102, from coming in close contact with a bottom surface of the dividing cap 220 to maintain the diaphragm 210 spaced a predetermined distance apart from the through-hole 222.

The contact preventing protrusion 220*a* prevents the diaphragm 210 from coming in close contact with the through-hole 222 and blocking the through-hole 222.

The dividing cap 220 further includes a manual operation lever 223 which is inserted and coupled to an outer surface of the support protrusion 221 and moves upward and downward along the support protrusion 221 to press the opening/closing member 230 placed directly above the manual operation lever 223 so that the opening/closing member 230 blocking the through-hole 222 is lifted upward.

The manual operation lever 223 may be connected and installed to be exposed to the outside of the housing 100 and may be operated from the outside.

The manual operation lever 223 is operated by a user's operation in a state in which driving of the lifting/lowering driving device 240 is limited.

The manual operation lever 223 may be operated using the leverage principle.

The opening/closing member 230 moves upward in the upper space 100*a* to open the through-hole 222 and comes in close contact with the upper surface of the support protrusion 221 to block the through-hole 222.

By opening the through-hole 222, the opening/closing member 230 allows the water staying between the dividing cap 220 and the diaphragm 210 to be discharged to the upper space 100*a* through the through-hole 222.

By blocking the through-hole 222, the opening/closing member 230 maintains a state in which water stays in the space between the dividing cap 220 and the diaphragm 210.

The lifting/lowering driving device 240 receives an external signal and moves the opening/closing member 230 upward or downward.

The lifting/lowering driving device 240 may be operated to be lifted or lowered using a solenoid valve to move the opening/closing member 230 upward or downward or may be operated to be lifted or lowered by rotation using a ball screw driven by a motor to move the opening/closing member 230 upward or downward.

The rotary cam device 250 is eccentrically rotated while supporting the diaphragm 210 and guides the diaphragm 210 to gradually move downward toward the upper end of the water discharge hole 102 to correspond to an outer shape.

The rotary cam device 250 induces the diaphragm 210 to move downward and gradually block the upper end of the water discharge hole 102 so that a discharge amount of water discharged through a gap between the diaphragm 210 and the water discharge hole 102 gradually decreases.

The rotary cam device 250 is installed on an inner wall surface of any one of the water discharge holes 102 of the housing 100 that are symmetrical to each other or installed on each of the water discharge holes 102 of the housing 100 that are symmetrical to each other to guide the downward movement of the diaphragm 210.

The rotary cam device 250 includes a shaft 251 which has one end rotatably installed on the inner wall surface of the water discharge hole 102 of the housing 100 and the other end installed to be exposed to the outside of the housing 100 and has an eccentric protrusion 251*a* formed on an outer surface to support the diaphragm 210 and, by being eccentrically rotated, guide the diaphragm 210 to gradually move downward and a stepper motor 252 which is installed to be fixed to an outer surface of the housing 100 and is connected to the other end of the shaft 251 to rotate the shaft 251 by a predetermined angle.

When the diaphragm 210 moves upward and away from the upper end of the water discharge hole 102, the shaft 251 is rotated by the stepper motor 252 and disposed so that the eccentric protrusion 251*a* faces upward.

When the diaphragm 210 moves downward toward the upper end of the water discharge hole 102 and the diaphragm 210 is supported by the eccentric protrusion 251*a* while in close contact therewith, the shaft 251 is rotated by the stepper motor 252 and rotated so that the eccentric protrusion 251*a* faces downward, and thus the diaphragm 210 is guided to gradually move downward.

The shaft 251 has one end caught in and fixed to the inner wall surface of the water discharge hole 102 and is prevented from falling out of the water discharge hole 102.

The shaft 251 is rotated by a predetermined angle by the stepper motor 252 so that the eccentric protrusion 251*a* is placed upward or placed downward.

The shaft 251 may have the eccentric protrusion 251*a* formed as a pair of eccentric protrusions 251*a* symmetrical to each other and may allow a bottom surface of the diaphragm 210 to come in close contact with the eccentric protrusion 251*a*.

When the diaphragm 210 is moved upward or the diaphragm 210 is supported by the eccentric protrusion 251*a* of the shaft 251 while in close contact therewith, the stepper motor 252 is driven to rotate the shaft 251 180°.

The stepper motor 252 rotates the shaft 251 in a forward direction or a reverse direction.

The water supply system for sanitary ceramics according to the first embodiment of the present disclosure configured as above is used as follows.

The water supply system for sanitary ceramics according to the present disclosure may be installed in the sanitary ceramic 10 or installed in a bidet (not illustrated) installed on the sanitary ceramic 10, but in the following description, the case in which the water supply system is installed in the sanitary ceramic 10 will be described as an example.

First, the water discharge holes 102 of the water supply system installed in the sanitary ceramic 10 are each connected to the rim pipe 12 and the jet pipe 13, and the water supply hole 101 is connected to a tap.

Then, when a lever (not illustrated) is operated to dispose of human waste in the bowl 11 of the sanitary ceramic 10, water is supplied to the water supply hole 101 through the tap (not illustrated), and simultaneously, the opening/closing device 200 connected to the rim pipe 12 is operated first, and the opening/closing device 200 connected to the jet pipe 13 is operated afterwards.

In the following description, the water discharge hole 102 connected to the rim pipe 12 and the water discharge hole 102 connected to the jet pipe 13 are opened or closed by the opening/closing devices 200 having the same operational structure.

Then, water supplied to the water supply hole 101 moves to a portion directly above the water supply hole 101 and then moves toward the water discharge hole 102 through the flow path 103.

Here, when the lifting/lowering driving device 240 of the opening/closing device 200 is operated and moves the opening/closing member 230 upward, the through-hole 222 of the dividing cap 220 is opened, and in particular, the water staying between the dividing cap 220 and the diaphragm 210 is discharged to the upper space 100*a* of the housing 100 through the through-hole 222, and the pressure in the space between the dividing cap 220 and the diaphragm 210 gradually decreases.

Here, the lifting/lowering driving device 240 is operated to be lifted or lowered using a solenoid valve to move the opening/closing member 230 upward or downward.

Then, the diaphragm 210 moving upward toward the bottom surface of the dividing cap 220 comes in close contact with the contact preventing protrusion 220*a*, and the diaphragm 210 is prevented from coming in close contact with the bottom surface of the dividing cap 220 and blocking the through-hole 222.

In particular, as the water in the space between the dividing cap 220 and the diaphragm 210 is discharged to the upper space 100*a* through the through-hole 222 of the dividing cap 220, an amount of water staying in the upper space 100*a* increases, and the pressure of water between the diaphragm 210 and the dividing cap 220 gradually decreases.

Here, due to the pressure of water moving toward the water discharge hole 102 through the flow path 103 in addition to a decrease of pressure in the space between the dividing cap 220 and the diaphragm 210, the diaphragm 210 closing the water discharge hole 102 is gradually pushed upward and thus opens the upper end of the water discharge hole 102.

That is, as the water staying between the diaphragm 210 and the dividing cap 220 is discharged to the upper space 100*a* through the through-hole 222, the pressure of water between the diaphragm 210 and the dividing cap 220 gradually decreases and becomes lower than the pressure of water that is applied to the bottom surface of the diaphragm 210, and thus the diaphragm 210 gradually opens the water discharge hole 102.

Here, while the diaphragm 210 is moved upward to open the water discharge hole 102, the stepper motor 252 of the rotary cam device 250 is driven to rotate the shaft 251 by a predetermined angle.

Then, the shaft 251 is rotated by the stepper motor 252 to maintains a state in which the shaft 251 is disposed so that the eccentric protrusion 251*a* formed on an outer surface of the shaft 251 faces upward.

Afterwards, water moving through the flow path 103 is supplied to the rim pipe 12 through the open water discharge hole 102, is discharged to an inner circumferential surface of the bowl 11 through the rim pipe 12, and flows down along the inner circumferential surface of the bowl 11.

Also, when water is discharged through the water discharge hole 102 connected to the rim pipe 12, after a certain amount of time, the opening/closing device 200 configured to open or close the water discharge hole 102 connected to the jet pipe 13 opens the water discharge hole 102 in the same manner as above to discharge water into the bowl 11 through the jet pipe 13.

Also, in order to fill the bowl 11 in the sanitary ceramic 10 with water, among the opening/closing devices 200, the opening/closing device 200 connected to the rim pipe 12 performs the opening operation to discharge water through the rim pipe 12, thus filling the bowl 11 with water.

Meanwhile, while the discharge of water into the bowl 11 through the rim pipe 12 or the jet pipe 13 is completed and the bowl 11 is filled with water, the lifting/lowering driving device 240 moves the opening/closing member 230 downward so that the opening/closing member 230 comes in close contact with the support protrusion 221.

Then, the through-hole 222 is blocked by the opening/closing member 230, and here, as water staying in the lower space 100*b* of the housing 100 is introduced into a portion between the dividing cap 220 and the diaphragm 210 through the guide hole 211 of the diaphragm 210 and the amount of water staying between the diaphragm 210 and the dividing cap 220 gradually increases, the pressure of water in the space between the dividing cap 220 and the diaphragm 210 gradually increases proportional to the amount of water.

That is, as the pressure of water staying between the dividing cap 220 and the diaphragm 210 gradually increases and presses the diaphragm 210 toward the water discharge hole 102, the diaphragm 210 is moved downward.

Also, the diaphragm 210 moving downward toward the water discharge hole 102 is supported by the eccentric protrusion 251*a* of the rotary cam device 250 while in close contact therewith, and here, a state in which water is continuously discharged to the water discharge hole 102 through a gap between the water discharge hole 102 and the diaphragm 210 is maintained to prevent water from colliding with the diaphragm 210.

Then, the stepper motor 252 is driven to rotate the shaft 251, and accordingly, as the shaft 251 is gradually rotated so that the eccentric protrusion 251*a* supporting the diaphragm 210 faces downward due to the shaft 251, the diaphragm 210 is guided to gradually move downward.

Also, at the moment the shaft 251 is disposed so that the eccentric protrusion 251*a* of the shaft 251 faces downward, the diaphragm 210 moves downward and blocks the upper end of the water discharge hole 102.

Here, as water moving toward the water discharge hole 102 through the water supply hole 101 and the flow path 103 of the housing 100 is discharged to the water discharge hole 102 through the gap between the diaphragm 210 and the water discharge hole 102 that gradually narrows due to the upward movement of the diaphragm 210, the flow of water gradually decreases, and thus collision of water with the diaphragm 210 is prevented by a flow velocity of the water moving toward the water discharge hole 102 through the flow path 103.

Here, at the moment the diaphragm 210 moves downward and blocks the upper end of the water discharge hole 102, the pressure of water introduced into the portion between the dividing cap 220 and the diaphragm 210 through the guide hole 211 becomes equal to the pressure of water that is applied to the bottom surface of the diaphragm 210, and accordingly, the diaphragm 210 is maintained in a state in which the diaphragm 210 closes the upper end of the water discharge hole 102.

On the other hand, in a case in which the upward/downward movement of the opening/closing member 230 is limited due to the operation of the lifting/lowering driving device 240 being limited or an abnormal operation of the lifting/lowering driving device 240, the manual operation lever 223 installed in the dividing cap 220 is operated from the outside, and here, the manual operation lever 223 is moved upward along the outer surface of the support protrusion 221 and presses the opening/closing member 230 upward.

Then, the opening/closing member 230 moves upward and opens the through-hole 222, and then, in the same manner, the diaphragm 210 moves away from the water discharge hole 102 such that the water discharge hole 102 is opened.

Here, although the case in which the manual operation lever 223 is installed in the dividing cap 220 has been described above as an example in the present disclosure, the manual operation lever 223 may be connected to an operation lever (not denoted by a reference numeral) exposed to the outside of the housing 100 and be operated to be lifted or lowered by the operation lever (not denoted by a reference numeral).

Second Embodiment

Figure 7:
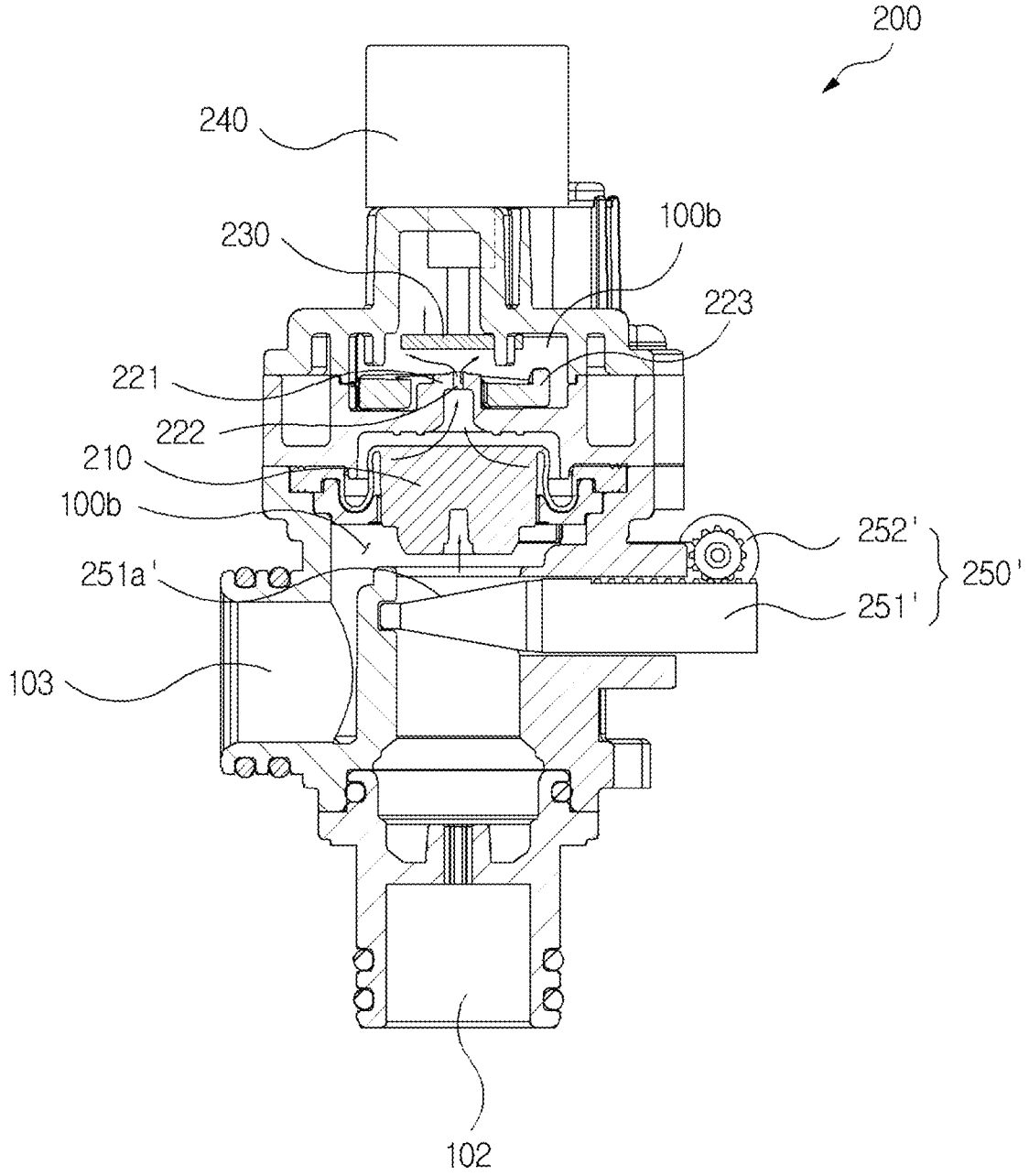
FIG. 7 is a lateral cross-sectional view illustrating a state in which a horizontal movement device is installed in a water supply system for sanitary ceramics according to a second embodiment of the present disclosure.
Figure 8:
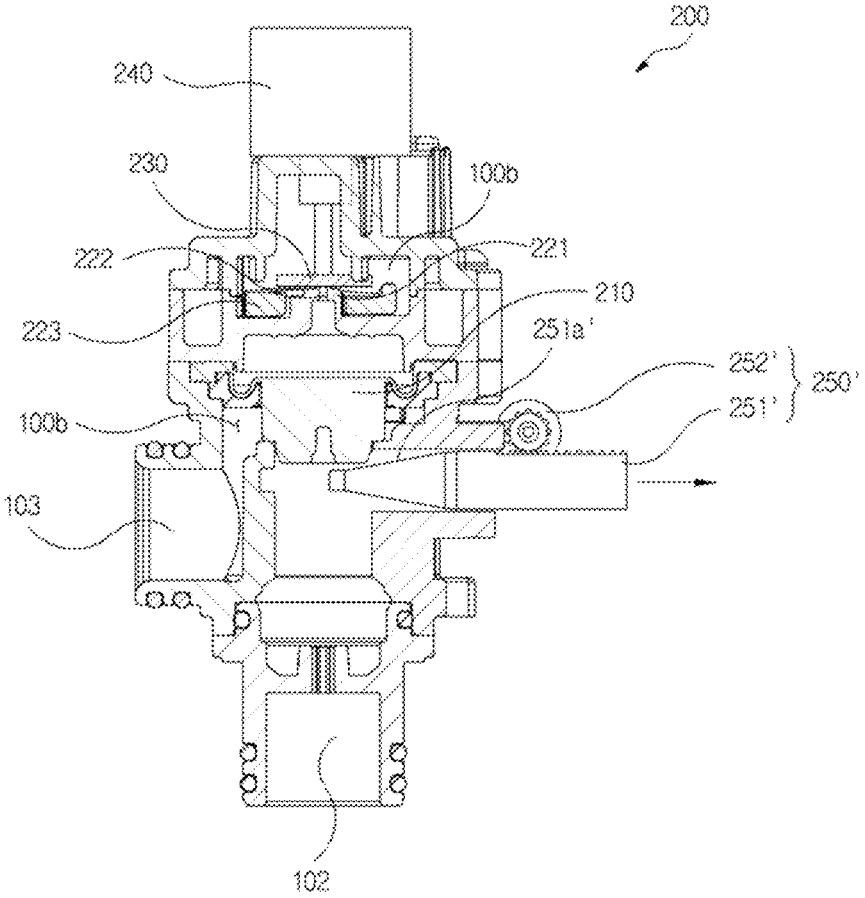
FIG. 8 is a lateral cross-sectional view illustrating a state in which the horizontal movement device of the water supply system for sanitary ceramics according to the second embodiment of the present disclosure is moved backward.
Figure 9:
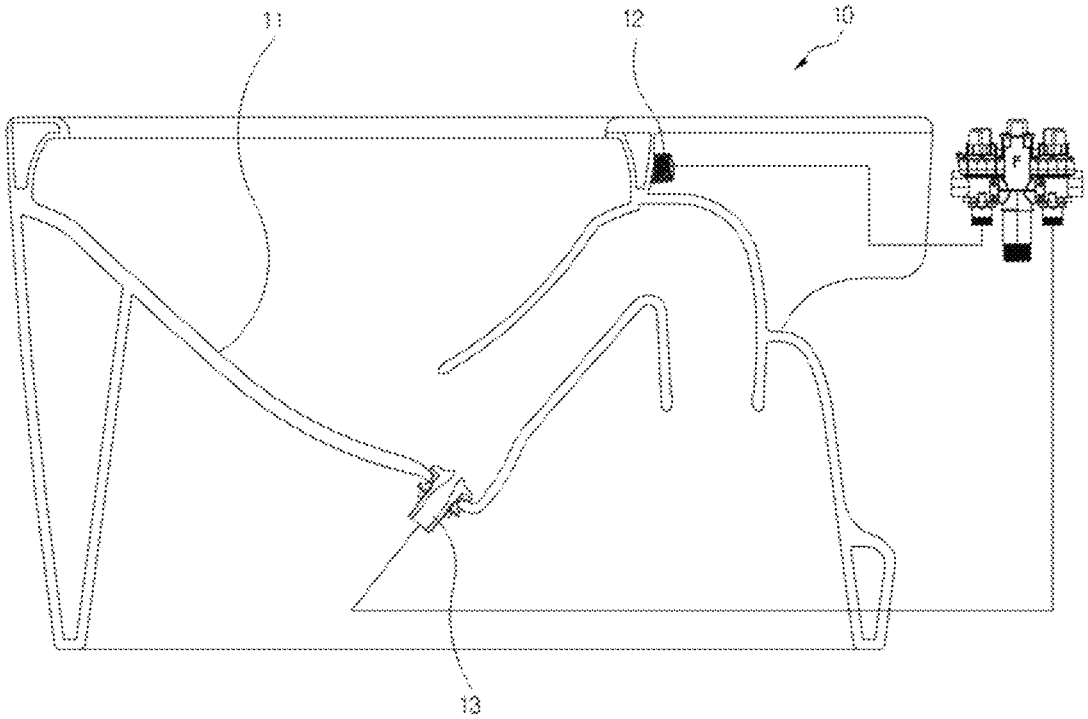
FIG. 9 is a view illustrating a state in which a water supply system for sanitary ceramics according to the present disclosure is installed in a toilet.

Referring to FIGS. 7 to 9, a housing 100 is hollow and has a water supply hole 101 formed at a central portion of a lower end, a pair of water discharge holes 102 formed at lower ends of both sides based on the water supply hole 101, and a flow path 103 formed between the water supply hole 101 and the water discharge hole 102 to guide water introduced through the water supply hole 101 to be discharged through the water discharge hole 102.

The housing 100 may be installed on an inner side of a sanitary ceramic 10 or installed in a bidet device (not illustrated) rotatably installed on an upper side of the sanitary ceramic 10.

The housing 100 receives water through the water supply hole 101 and guides the water to move to the water discharge hole 102 through the flow path 103.

The flow path 103 is formed to be orthogonal to the water supply hole 101 and the water discharge hole 102.

The water discharge hole 102 is closed or opened by an opening/closing device 200.

The water discharge hole 102 of the housing 100 has an upper end disposed in a lower space 100*b* of the housing 100 and is opened or closed by a diaphragm 210 of the opening/closing device 200.

The upper end of the water discharge hole 102 is blocked by the diaphragm 210 moving downward so that discharge of water introduced through the water supply hole 101 is blocked.

A horizontal movement device 250' of the opening/closing device 200 may be allowed to be installed on an inner wall surface of the water discharge hole 102.

The water discharge holes 102 are each connected to a rim pipe 12 and a jet pipe 13 installed in a bowl 11 of the sanitary ceramic 10.

The housing 100 is divided into an upper space 100*a* and the lower space 100*b* by a dividing cap 220 installed therein.

The opening/closing device 200 is installed on an upper side of the water discharge hole 102 of the housing 100 to open or block the upper end of the water discharge hole 102.

The opening/closing device 200 includes the diaphragm 210 which is installed on an upper portion of the water discharge hole 102, has a guide hole 211 formed in an outer edge thereof, and is configured to move upward or downward to open or close the water discharge hole 102, the dividing cap 220 which is installed on an upper portion of the diaphragm 210 to divide the inside of the housing 100 into the upper and lower spaces 100*a* and 100*b* and has a support protrusion 221 formed on an upper surface thereof and a through-hole 222 formed downward from an upper surface of the support protrusion 221 to communicate with the upper and lower spaces 100*a* and 100*b*, an opening/closing member 230 which is installed to be movable upward or downward in the upper space 100*a* of the housing 100 to come in close contact with the upper surface of the support protrusion 221 of the dividing cap 220 or move away from the upper surface of the support protrusion 221 to open or block the through-hole 222, a lifting/lowering driving device 240 which is installed to be fixed to an upper surface of the housing 100 that faces the water discharge hole 102 and has a lower end connected to the opening/closing member 230 to move the opening/closing member 230 upward or downward, and the horizontal movement device 250' which is installed to be horizontally movable on the inner wall surface of the water discharge hole 102 of the housing 100 and configured to allow the diaphragm 210, which is moving downward, to come in close contact with an outer surface thereof and, by being moved backward, guide the diaphragm 210 to gradually move downward to guide the diaphragm 210 to gradually block the water discharge hole 102.

The diaphragm 210 is moved upward or downward in a state in which an edge thereof is pressed and supported between the housing 100 and an edge of the dividing cap 220.

The diaphragm 210 allows water staying in the lower space 100*b* of the housing 100 to enter a space between the diaphragm 210 and the dividing cap 220 through the guide hole 211.

The diaphragm 210 is pushed by pressure of water entering the space between the dividing cap 220 and the diaphragm 210 and thus maintains a state in which the upper end of the water discharge hole 102 is closed by the diaphragm 210.

The pressure of water staying between the diaphragm 210 and the dividing cap 220 may be equal to the pressure of water staying in the lower space 100*b* of the housing 100.

At the moment the water staying between the dividing cap 220 and the diaphragm 210 is discharged to the upper space 100*a* of the housing 100 through the through-hole 222, the diaphragm 210 is pushed by the pressure of water moving toward the water discharge hole 102 through the flow path 103 and is gradually moved upward, thus opening the upper end of the water discharge hole 102.

The dividing cap 220 divides the housing 100 into the upper space 100*a* and the lower space 100*b* and allows the opening/closing member 230 and the diaphragm 210 to be disposed in each of the upper space 100*a* and the lower space 100*b*.

The support protrusion 221 of the dividing cap 220 allows the opening/closing member 230, configured to move upward or downward in the upper space 100*a*, to come in close contact therewith so that the through-hole 222 is closed.

The through-hole 222 is opened by the opening/closing member 230 and allows the water staying in the space between the diaphragm 210 and the dividing cap 220 to be discharged to the upper space 100*a* of the housing 100 or is blocked by the opening/closing member 230 so that water stays in the space between the diaphragm 210 and the dividing cap 220.

The dividing cap 220 further includes a contact preventing protrusion 220*a* which is formed to protrude downward from an edge of a bottom surface of the through-hole 222 and prevents the diaphragm 210, moving upward and away from the water discharge hole 102, from coming in close contact with a bottom surface of the dividing cap 220 to maintain the diaphragm 210 spaced a predetermined distance apart from the through-hole 222.

The contact preventing protrusion 220*a* prevents the diaphragm 210 from coming in close contact with the through-hole 222 and blocking the through-hole 222.

The dividing cap 220 further includes a manual operation lever 223 which is inserted and coupled to an outer surface of the support protrusion 221 and moves upward and downward along the support protrusion 221 to press the opening/closing member 230 placed directly above the manual operation lever 223 so that the opening/closing member 230 blocking the through-hole 222 is lifted upward.

The manual operation lever 223 may be connected and installed to be exposed to the outside of the housing 100 and may be operated from the outside.

The manual operation lever 223 is operated by a user's operation in a state in which driving of the lifting/lowering driving device 240 is limited.

The manual operation lever 223 may be operated using the leverage principle.

The opening/closing member 230 moves upward in the upper space 100*a* to open the through-hole 222 and comes in close contact with the upper surface of the support protrusion 221 to block the through-hole 222.

By opening the through-hole 222, the opening/closing member 230 allows the water staying between the dividing cap 220 and the diaphragm 210 to be discharged to the upper space 100*a* through the through-hole 222.

By blocking the through-hole 222, the opening/closing member 230 maintains a state in which water stays in the space between the dividing cap 220 and the diaphragm 210.

The lifting/lowering driving device 240 receives an external signal and moves the opening/closing member 230 upward or downward.

The lifting/lowering driving device 240 may be operated to be lifted or lowered using a solenoid valve to move the opening/closing member 230 upward or downward or may be operated to be lifted or lowered by rotation using a ball screw driven by a motor to move the opening/closing member 230 upward or downward.

The horizontal movement device 250' is moved backward to be exposed to the outside of the housing 100 while supporting the diaphragm 210 and guides the diaphragm 210 to gradually move downward toward the upper end of the water discharge hole 102 to correspond to an outer shape.

The horizontal movement device 250' induces the diaphragm 210 to move downward and gradually block the upper end of the water discharge hole 102 so that a discharge amount of water discharged through a gap between the diaphragm 210 and the water discharge hole 102 gradually decreases.

The horizontal movement device 250' is installed on an inner wall surface of any one of the water discharge holes 102 of the housing 100 that are symmetrical to each other or installed on each of the water discharge holes 102 of the housing 100 that are symmetrical to each other to guide the downward movement of the diaphragm 210.

The horizontal movement device 250' includes a support member 251' which has one end disposed in the water discharge hole 102 of the housing 100 and the other end installed to be exposed to the outside of the housing 100, has an inclined surface 251*a*' formed on an outer surface to be tapered from the other end toward the one end to support the diaphragm 210, and is configured to, by being moved backward toward the outside of the housing 100 in the water discharge hole 102, guide the diaphragm 210 to gradually move downward and a driving device 252' which is installed to be fixed to an outer surface of the housing 100 and is connected to the other end of the support member 251' to move the support member 251' backward.

The support member 251' allows the diaphragm 210 to be supported by the inclined surface 251*a*' while in close contact therewith and, by moving backward, guides the diaphragm 210 to slide corresponding to the shape of the inclined surface 251*a*' and move downward.

When the diaphragm 210 moves upward and away from the upper end of the water discharge hole 102, the support member 251' is horizontally moved by the driving device 252' and disposed in a space inside the water discharge hole 102.

When the diaphragm 210 moves downward toward the upper end of the water discharge hole 102 and the diaphragm 210 is supported by the inclined surface 251*a*' while in close contact therewith, the support member 251' is horizontally moved by the driving device 252' and guides the diaphragm 210 to slide corresponding to the shape of the inclined surface 251*a*' and move downward.

The support member 251' has one end maintained to float in the air in the water discharge hole 102.

The support member 251' is horizontally moved by the driving device 252' so that the diaphragm 210 is supported by the inclined surface 251*a*' while in close contact therewith.

An angle of the inclined surface 251*a*' of the support member 251' may be adjusted by a user.

When the diaphragm 210 is moved upward or the diaphragm 210 is supported by the inclined surface 251*a*' of the support member 251' while in close contact therewith, the driving device 252' is operated to horizontally move the support member 251' forward or backward.

The horizontal movement device 250' has the support member 251' and the driving device 252' fastened using any one of a worm gear, a rack pinion gear, and a ball screw so that the support member 251' moves backward.

The water supply system for sanitary ceramics according to the second embodiment of the present disclosure configured as above is used as follows.

The water supply system for sanitary ceramics according to the present disclosure may be installed in the sanitary ceramic 10 or installed in a bidet (not illustrated) installed on the sanitary ceramic 10, but in the following description, the case in which the water supply system is installed in the sanitary ceramic 10 will be described as an example.

First, the water discharge holes 102 of the water supply system installed in the sanitary ceramic 10 are each connected to the rim pipe 12 and the jet pipe 13, and the water supply hole 101 is connected to a tap.

Then, when a lever (not illustrated) is operated to dispose of human waste in the bowl 11 of the sanitary ceramic 10, water is supplied to the water supply hole 101 through the tap (not illustrated), and simultaneously, the opening/closing device 200 connected to the rim pipe 12 is operated first, and the opening/closing device 200 connected to the jet pipe 13 is operated afterwards.

In the following description, the water discharge hole 102 connected to the rim pipe 12 and the water discharge hole 102 connected to the jet pipe 13 are opened or closed by the opening/closing devices 200 having the same operational structure.

Then, water supplied to the water supply hole 101 moves to a portion directly above the water supply hole 101 and then moves toward the water discharge hole 102 through the flow path 103.

Here, when the lifting/lowering driving device 240 of the opening/closing device 200 is operated and moves the opening/closing member 230 upward, the through-hole 222 of the dividing cap 220 is opened, and here, as the water staying between the dividing cap 220 and the diaphragm 210 is discharged to the upper space 100*a* of the housing 100 through the through-hole 222, the pressure in the space between the dividing cap 220 and the diaphragm 210 gradually decreases.

Here, the lifting/lowering driving device 240 is operated to be lifted or lowered using a solenoid valve to move the opening/closing member 230 upward or downward.

Then, the diaphragm 210 moving upward toward the bottom surface of the dividing cap 220 comes in close contact with the contact preventing protrusion 220*a*, and the diaphragm 210 is prevented from coming in close contact with the bottom surface of the dividing cap 220 and blocking the through-hole 222.

In particular, as the water in the space between the dividing cap 220 and the diaphragm 210 is discharged to the upper space 100*a* through the through-hole 222 of the dividing cap 220, the amount of water staying in the upper space 100*a* increases, and the pressure of water between the diaphragm 210 and the dividing cap 220 gradually decreases.

Here, due to the pressure of water moving toward the water discharge hole 102 through the flow path 103 in addition to a decrease of pressure in the space between the dividing cap 220 and the diaphragm 210, the diaphragm 210 closing the water discharge hole 102 is gradually pushed upward and thus opens the upper end of the water discharge hole 102.

That is, as the water staying between the diaphragm 210 and the dividing cap 220 is discharged to the upper space 100*a* through the through-hole 222, the pressure of water between the diaphragm 210 and the dividing cap 220 gradually decreases and becomes lower than the pressure of water that is applied to the bottom surface of the diaphragm 210, and thus the diaphragm 210 gradually opens the water discharge hole 102.

Here, while the diaphragm 210 is moved upward to open the water discharge hole 102, the driving device 252' of the horizontal movement device 250' is driven to horizontally move the support member 251'.

Then, the support member 251' is horizontally moved by the driving device 252' to maintain a state in which the support member 251' floats in the air in the water discharge hole 102.

Afterwards, water moving through the flow path 103 is supplied to the rim pipe 12 through the open water discharge hole 102, is discharged to an inner circumferential surface of the bowl 11 through the rim pipe 12, and flows down along the inner circumferential surface of the bowl 11.

Also, when water is discharged through the water discharge hole 102 connected to the rim pipe 12, after a certain amount of time, the opening/closing device 200 configured to open or close the water discharge hole 102 connected to the jet pipe 13 opens the water discharge hole 102 in the same manner as above to discharge water into the bowl 11 through the jet pipe 13.

Also, in order to fill the bowl 11 in the sanitary ceramic 10 with water, among the opening/closing devices 200, the opening/closing device 200 connected to the rim pipe 12 performs the opening operation to discharge water through the rim pipe 12, thus filling the bowl 11 with water.

Meanwhile, while the discharge of water into the bowl 11 through the rim pipe 12 or the jet pipe 13 is completed and the bowl 11 is filled with water, the lifting/lowering driving device 240 moves the opening/closing member 230 downward so that the opening/closing member 230 comes in close contact with the support protrusion 221.

Then, the through-hole 222 is blocked by the opening/closing member 230, and here, as water staying in the lower space 100*b* of the housing 100 is introduced into a portion between the dividing cap 220 and the diaphragm 210 through the guide hole 211 of the diaphragm 210 and the amount of water staying between the diaphragm 210 and the dividing cap 220 gradually increases, the pressure of water in the space between the dividing cap 220 and the diaphragm 210 gradually increases proportional to the amount of water.

That is, as the pressure of water staying between the dividing cap 220 and the diaphragm 210 gradually increases and presses the diaphragm 210 toward the water discharge hole 102, the diaphragm 210 is moved downward.

Also, the diaphragm 210 moving downward toward the water discharge hole 102 is supported by the inclined surface 251*a*' formed on the support member 251' of the horizontal movement device 250' while in close contact therewith, and here, a state in which water is continuously discharged to the water discharge hole 102 through a gap between the water discharge hole 102 and the diaphragm 210 is maintained to prevent water from colliding with the diaphragm 210.

Then, the driving device 252' is driven to move the support member 251' backward, and accordingly, as the support member 251' moves backward to be exposed to the outside of the housing 100, the diaphragm 210 supported by the inclined surface 251*a*' while in close contact therewith slides down corresponding to the shape of the inclined surface 251*a*', and thus the diaphragm 210 gradually moves downward.

Here, the driving device 252' is fastened to the support member 251' using any one of a worm gear, a rack pinion gear, and a ball screw to horizontally move the support member 251'.

Also, at the moment the backward movement of the support member 251' by the driving device 252' is completed, the diaphragm 210 moves downward and blocks the upper end of the water discharge hole 102.

Here, as water moving toward the water discharge hole 102 through the water supply hole 101 and the flow path 103 of the housing 100 is discharged to the water discharge hole 102 through the gap between the diaphragm 210 and the water discharge hole 102 that gradually narrows due to the upward movement of the diaphragm 210, the flow of water gradually decreases, and thus collision of water with the diaphragm 210 is prevented by a flow velocity of the water moving toward the water discharge hole 102 through the flow path 103.

Here, at the moment the diaphragm 210 moves downward and blocks the upper end of the water discharge hole 102, the pressure of water introduced into the portion between the dividing cap 220 and the diaphragm 210 through the guide hole 211 becomes equal to the pressure of water that is applied to the bottom surface of the diaphragm 210, and accordingly, the diaphragm 210 is maintained in a state in which the diaphragm 210 closes the upper end of the water discharge hole 102.

On the other hand, in a case in which the upward/downward movement of the opening/closing member 230 is limited due to the operation of the lifting/lowering driving device 240 being limited or an abnormal operation of the lifting/lowering driving device 240, the manual operation lever 223 installed in the dividing cap 220 is operated from the outside, and here, the manual operation lever 223 is moved upward along the outer surface of the support protrusion 221 and presses the opening/closing member 230 upward.

Then, the opening/closing member 230 moves upward and opens the through-hole 222, and then, in the same manner, the diaphragm 210 moves away from the water discharge hole 102 such that the water discharge hole 102 is opened.

Here, although the case in which the manual operation lever 223 is installed in the dividing cap 220 has been described above as an example in the present disclosure, the manual operation lever 223 may be connected to an operation lever (not denoted by a reference numeral) exposed to the outside of the housing 100 and be operated to be lifted or lowered by the operation lever (not denoted by a reference numeral).

The case in which the rotary cam device 250, installed on the inner wall surface of the water discharge hole 102 of the water supply system for sanitary ceramics, is rotated to cause the diaphragm 210 to gradually move downward or the horizontal movement device 250' is moved backward to cause the diaphragm 210 to gradually move downward has been described above as an example. However, a lifting/lowering support (not illustrated) configured to move upward or downward may be installed in the water discharge hole 210, and the diaphragm 210 may be supported by an upper end of the lifting/lowering support (not illustrated) so that the diaphragm 210 moves downward by the lifting/lowering support (not illustrated) moving downward.

In the above-described structure in which the rotary cam device 250 configured to support the diaphragm 210 and control a downward movement speed of the diaphragm 210 is installed on the inner wall surface of the water discharge hole 102 of the housing so that the diaphragm 210 gradually blocks the water discharge hole 102, the rotary cam device 250 supports the diaphragm 210 moving downward and, by being eccentrically rotated, guides the diaphragm 210 to gradually move downward, and thus the water discharge hole 102 is prevented from being suddenly blocked by the diaphragm 210, and the water discharge hole 102 is gradually blocked such that the flow of water discharged through the water discharge hole 102 is prevented from being suddenly blocked. Also, the flow of water discharged through the water discharge hole 102 is gradually decreased such that there is no concern about an occurrence of a water hammer due to water colliding with the diaphragm 210.

According to the present disclosure, there are advantages that a rotary cam device supports a diaphragm configured to move downward and, by being eccentrically rotated, guides the diaphragm to gradually move downward so that a water discharge hole is prevented from being suddenly blocked by the diaphragm and the water discharge hole is gradually blocked to prevent a flow of water discharged through the water discharge hole from being suddenly blocked. Also, since the flow of water discharged through the water discharge hole is gradually reduced, there is no concern about an occurrence of a water hammer due to water colliding with the diaphragm, and since noise generation is prevented due to preventing a water hammer, there is no concern of causing a user of the product to feel anxious. In particular, since generation of vibration due to impact is prevented in pipes or components while a water hammer is prevented, an occurrence of damage to the pipes or components or formation of cracks therein is prevented, and accordingly, it is convenient to perform maintenance and repair, and the product reliability is improved.

The water supply system for sanitary ceramics according to the present disclosure that has been described above is not limited to the above-described embodiments, and the technical spirit of the present disclosure is within the scope in which those of ordinary skill in the art to which the present disclosure pertains can modify the present disclosure in various ways without departing from the gist of the present disclosure that is claimed in the appended claims.

What is claimed is:

1. A water supply system for sanitary ceramics, the water supply system comprising:

a housing (100) which is hollow and in which a water supply hole (101) is formed at a central portion of a lower end, a pair of water discharge holes (102) are formed at lower ends of both sides based on the water supply hole (101), and a flow path (103) configured to guide water introduced through the water supply hole (101) to be discharged through the water discharge hole (102) is formed between the water supply hole (101) and the water discharge hole (102); and an opening/closing device (200) installed on an upper side of the water discharge hole (102) of the housing (100) to open or block an upper end of the water discharge hole (102), wherein the opening/closing device (200) includes a diaphragm (210) which is installed on an upper portion of the water discharge hole (102), has a guide hole (211) formed in an outer edge thereof, and is configured to move upward or downward to open or close the water discharge hole (102), a dividing cap (220) which is installed on an upper portion of the diaphragm (210) to divide an inside of the housing (100) into upper and lower spaces (100*a*, 100*b*) and has a support protrusion (221) formed on an upper surface thereof and a through-hole (222) formed downward from an upper surface of the support protrusion (221) to communicate with the upper and lower spaces (100*a*, 100*b*), an opening/closing member (230) which is installed to be movable upward or downward in the upper space (100*a*) of the housing (100) to come in close contact with the upper surface of the support protrusion (221) of the dividing cap (220) or move away from the upper surface of the support protrusion (221) to open or block the through-hole (222), a lifting/lowering driving device (240) which is installed to be fixed to an upper surface of the housing (100) that faces the water discharge hole (102) and has a lower end connected to the opening/closing member (230) to move the opening/closing member (230) upward or downward, and a rotary cam device (250) which is rotatably installed on an inner wall surface of the water discharge hole (102) of the housing (100) and configured to allow the diaphragm (210), which is moving downward, to be supported by an outer surface thereof and, by being eccentrically rotated, guide the diaphragm (210) to gradually move downward to guide the diaphragm (210) to gradually block the water discharge hole (102).

2. The water supply system of claim 1, wherein the rotary cam device (250) is installed on an inner wall surface of any one of the water discharge holes (102) of the housing (100) that are symmetrical to each other or installed on each of the water discharge holes (102) of the housing (100) that are symmetrical to each other to guide the downward movement of the diaphragm (210).

3. The water supply system of claim 1, wherein the rotary cam device (250) includes:

a shaft (251) which has one end rotatably installed on the inner wall surface of the water discharge hole (102) of the housing (100) and the other end installed to be exposed to an outside of the housing (100) and has an eccentric protrusion (251*a*) formed on an outer surface to support the diaphragm (210) and, by being eccentrically rotated, guide the diaphragm (210) to gradually move downward; and a stepper motor (252) which is installed to be fixed to an outer surface of the housing (100) and is connected to the other end of the shaft (251) to rotate the shaft (251) by a predetermined angle.

4. A water supply system for sanitary ceramics, the water supply system comprising:

a housing (100) which is hollow and in which a water supply hole (101) is formed at a central portion of a lower end, a pair of water discharge holes (102) are formed at lower ends of both sides based on the water supply hole (101), and a flow path (103) configured to guide water introduced through the water supply hole (101) to be discharged through the water discharge hole (102) is formed between the water supply hole (101) and the water discharge hole (102); and an opening/closing device (200) installed on an upper side of the water discharge hole (102) of the housing (100) to open or block an upper end of the water discharge hole (102), wherein the opening/closing device (200) includes a diaphragm (210) which is installed on an upper portion of the water discharge hole (102), has a guide hole (211) formed in an outer edge thereof, and is configured to move upward or downward to open or close the water discharge hole (102), a dividing cap (220) which is installed on an upper portion of the diaphragm (210) to divide an inside of the housing (100) into upper and lower spaces (100*a*, 100*b*) and has a support protrusion (221) formed on an upper surface thereof and a through-hole (222) formed downward from an upper surface of the support protrusion (221) to communicate with the upper and lower spaces (100*a*, 100*b*), an opening/closing member (230) which is installed to be movable upward or downward in the upper space (100*a*) of the housing (100) to come in close contact with the upper surface of the support protrusion (221) of the dividing cap (220) or move away from the upper surface of the support protrusion (221) to open or block the through-hole (222), a lifting/lowering driving device (240) which is installed to be fixed to an upper surface of the housing (100) that faces the water discharge hole (102) and has a lower end connected to the opening/closing member (230) to move the opening/closing member (230) upward or downward, and a horizontal movement device (250') which is installed to be horizontally movable on an inner wall surface of the water discharge hole (102) of the housing (100) and configured to allow the diaphragm (210), which is moving downward, to come in close contact with an outer surface thereof and, by being moved backward, guide the diaphragm (210) to gradually move downward to guide the diaphragm (210) to gradually block the water discharge hole (102).

5. The water supply system of claim 4, wherein the horizontal movement device (250') is installed on an inner wall surface of any one of the water discharge holes (102) of the housing (100) that are symmetrical to each other or installed on each of the water discharge holes (102) of the housing (100) that are symmetrical to each other to guide the downward movement of the diaphragm (210).

6. The water supply system of claim 4, wherein the horizontal movement device (250') includes:

a support member (251') which has one end disposed in the water discharge hole (102) of the housing (100) and the other end installed to be exposed to an outside of the housing (100), has an inclined surface (251*a*') formed on an outer surface to be tapered from the other end toward the one end to support the diaphragm (210), and is configured to, by being moved backward toward the outside of the housing (100) in the water discharge hole (102), guide the diaphragm (210) to gradually move downward; and a driving device (252') which is installed to be fixed to an outer surface of the housing (100) and is connected to the other end of the support member (251') to move the support member (251') backward.

7. The water supply system of claim 6, wherein the horizontal movement device (250') has the support member (251') and the driving device (252') fastened using any one of a worm gear, a rack pinion gear, and a ball screw so that the support member (251') moves backward.

8. The water supply system of claim 1, wherein the dividing cap (220) further includes a manual operation lever (223) formed to be inserted and coupled to an outer surface of the support protrusion (221) and move upward and downward along the support protrusion (221) to press the opening/closing member (230) placed directly above the manual operation lever (223) so that the opening/closing member (230) blocking the through-hole (222) is lifted upward.

9. The water supply system of claim 2, wherein the rotary cam device (250) includes:

a shaft (251) which has one end rotatably installed on the inner wall surface of the water discharge hole (102) of the housing (100) and the other end installed to be exposed to an outside of the housing (100) and has an eccentric protrusion (251*a*) formed on an outer surface to support the diaphragm (210) and, by being eccentrically rotated, guide the diaphragm (210) to gradually move downward; and a stepper motor (252) which is installed to be fixed to an outer surface of the housing (100) and is connected to the other end of the shaft (251) to rotate the shaft (251) by a predetermined angle.

10. The water supply system of claim 2, wherein the dividing cap (220) further includes a manual operation lever (223) formed to be inserted and coupled to an outer surface of the support protrusion (221) and move upward and downward along the support protrusion (221) to press the opening/closing member (230) placed directly above the manual operation lever (223) so that the opening/closing member (230) blocking the through-hole (222) is lifted upward.

* * * * *